US006644491B2

(12) United States Patent
Dewig et al.

(10) Patent No.: US 6,644,491 B2
(45) Date of Patent: Nov. 11, 2003

(54) TAMPER-EVIDENT CAP

(75) Inventors: Chris A. Dewig, Evansville, IN (US); William T. Nally, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 176 days.

(21) Appl. No.: 09/933,367

(22) Filed: Aug. 20, 2001

(65) Prior Publication Data

US 2003/0034347 A1 Feb. 20, 2003

(51) Int. Cl.[7] ..... B65D 41/48; B65D 41/62

(52) U.S. Cl. ..... 220/276; 220/915; 215/256; 222/153.07; 222/541.9

(58) Field of Search ..... 220/276, 915; 215/256; 222/153.07, 153.1, 182, 541.6, 541.9

(56) References Cited

U.S. PATENT DOCUMENTS

| | | | | | |
|---|---|---|---|---|---|
| 2,973,881 | A | * | 3/1961 | Ostrowitz | 220/915 |
| 3,037,672 | A | * | 6/1962 | Gach | 220/915 |
| 3,162,329 | A | * | 12/1964 | Gregory | 220/915 |
| 3,170,602 | A | * | 2/1965 | Suellentrop, Jr. et al. | 220/915 |
| 3,266,676 | A | * | 8/1966 | McKernan | 222/153.07 |
| 3,396,866 | A | * | 8/1968 | Oppasser | 220/915 |
| 3,672,528 | A | | 6/1972 | Faulstich | |
| 3,684,124 | A | * | 8/1972 | Song | 222/153.07 |
| 3,831,798 | A | | 8/1974 | Rowe et al. | |
| 3,870,187 | A | * | 3/1975 | Bennett | 220/915 |
| 4,029,231 | A | | 6/1977 | Jonsson | |
| 4,625,876 | A | | 12/1986 | Bullock, III | |
| 4,735,337 | A | | 4/1988 | Von Holdt | |
| 4,738,375 | A | * | 4/1988 | Rosen et al. | 220/276 |
| 4,930,656 | A | | 6/1990 | Blanchette | |
| 4,962,864 | A | * | 10/1990 | Appal et al. | 220/915 |
| 5,042,680 | A | | 8/1991 | Argudo et al. | |
| 5,085,333 | A | * | 2/1992 | Dutt et al. | 220/276 |
| 5,100,011 | A | | 3/1992 | Maietta | |
| 5,105,960 | A | | 4/1992 | Crisci et al. | |
| 5,238,135 | A | | 8/1993 | Landis | |
| 5,248,050 | A | | 9/1993 | Janousch | |

FOREIGN PATENT DOCUMENTS

| | | |
|---|---|---|
| CH | 472321 | 6/1969 |
| GB | 977312 | 12/1964 |
| GB | 1205541 | 9/1970 |

* cited by examiner

*Primary Examiner*—Nathan J. Newhouse
(74) *Attorney, Agent, or Firm*—Barnes & Thornburg

(57) ABSTRACT

A tamper-resistant closure includes a cap provided with several cap retainers adapted to engage an annular ridge surrounding a discharge valve mounted on a can and a removable tamper band coupled to a lower edge of the cap to define an undulated frangible tear line between the cap and the tamper band. Several band retainers are provided on the tamper band and adapted to engage the annular ridge. The band retainers cooperate with the cap retainers to help retain the closure on the can while the tamper band remains coupled to the cap. Once the tamper band is removed, the cap retainers engage the annular ridge on the can and cooperate to retain the remaining cap on the can.

32 Claims, 5 Drawing Sheets

14
26
36
32
12
34
30
10
16
14
26
36
20
6
6
32
54
18
34
12
30

10
16
18
20
54
46
32
46
24
26
34
12

16
10
52
54
24
52
20
52
46
46
32
50
50
50
26
34
30

16
14
14
32
46
26
46
34
30

TAMPER-EVIDENT CAP

BACKGROUND AND SUMMARY OF THE INVENTION

This invention relates to overcaps for mounting on the top of cans or containers. More particularly, the present invention relates to a tamper-resistant overcap having a tear strip that must be removed before the overcap can be removed from the can or container.

Overcaps provide a protective covering for a dispensing device (e.g., push-to-spray button, discharge nozzle, etc.) positioned on the can or container. To remove the contents of the can or container the cap is removed and the dispensing device is activated. Such overcaps are typically formed in a mold using a plastics materials such as polypropylene or high density polyethylene.

The cans or containers are stores in warehouses and later displayed on store shelves for purchase by consumers. During the time period when the cans or containers are stores and displayed they may be accessible to people who wish to tamper with them. It is known to apply a shrink wrap cover to aerosol cans and lids to maximize the tamper resistance of such units. However, this extra packaging step takes time and increases packaging costs.

Consumers are able to determine if the can or containers they are purchasing has been tampered with if the can or container is covered by a tamper-resistant overcap. If the tear strip is missing when the consumer purchases the product, then the consumer is put on notice that the can or container may have been tampered with. After the tear strip is removed from the overcap, a remaining closure portion of the overcap is used to cover the can or containers.

According to the present disclosure, a tamper-resistant closure includes a cap and a removable tamper band coupled to a lower edge of the cap to define a frangible tear line between the cap and the tamper band. Retainers are provided on each of the cap and the removable tamper band for engaging an annular ridge on a can to retain the cap on the can. The tamper-resistant closure is mounted easily on a can having a body and a dome coupled to a top end of the body and formed to include an annular ridge surrounding a discharge valve mounted on the dome.

In preferred embodiments, the retainers on the tamper band cooperate with the retainers on the cap to retain the cap on the can as long as the tamper band is coupled to the cap and the closure is mounted on the can in a tamper-resistant position. Once the tamper band is separated from the cap along the frangible tear line, the cap can be mounted on the can by the consumer and the cap is retained on the can only by engagement of the remaining cap retainers on the cap with the annular ridge on the can.

Three "short" cap retainers are appended to an inner surface of the cap. These cap retainers are arranged to lie in circumferentially spaced-apart relation to one another and to engage the annular ridge on the can whether or not the tamper band is coupled to the cap. Three "long" tamper band retainers are appended to an inner surface of the removable tamper band. The tamper band retainers are arranged to engage the annular ridge on the can until the tamper band is removed by a consumer prior to removal of the cap from the can.

Also in preferred embodiments, the frangible tear line is undulated. Even though the cap retainers lie above the frangible tear line and the tamper band retainers lie below the frangible tear line, each tamper band retainer lies in a space between each pair of "adjacent" cap retainers to form an annular alternating series of cap and tamper band retainers because of the undulated character of the frangible tear line.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2, 3, 4, 5:
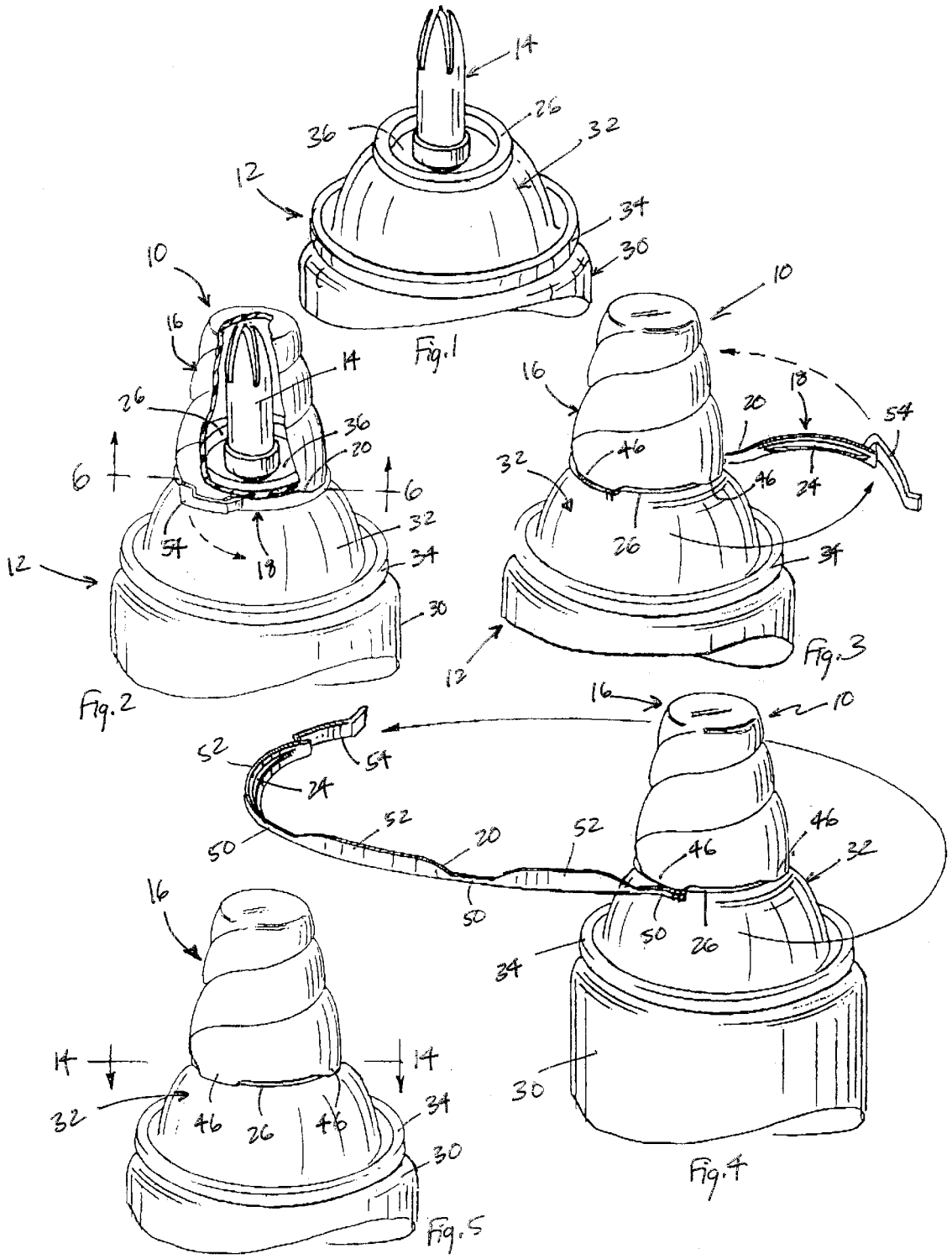
FIG. 1 is a perspective view of the top of a can containing a pressurized product such as whipped cream, the can comprising a body and a dome coupled to a top end of the body and formed to include an annular ridge surrounding a product discharge valve mounted on the dome.
FIG. 2 is a perspective view of an upper portion of the pressurized can of FIG. 1 carrying a closure in accordance with the present disclosure and showing a cap and a removable circular tamper band provided with a finger-pull tab and coupled to a lower edge of the cap along an undulated frangible tear line.
FIG. 3 is a view similar to FIG. 2 showing partial removal of the circular tamper band while the closure is still retained on the can.
FIG. 4 is a view similar to FIGS. 2 and 3 showing the circular tear band just before it is removed completely from the cap by the consumer at first use and showing an undulated top edge of the tamper band that had been coupled to a matching undulated lower edge of the cap along the undulated frangible tear line.
FIG. 5 is a perspective view similar to FIGS. 2–4 showing the cap retained on the annular ridge of a can after removal of the circular tamper band.
Figure 6:
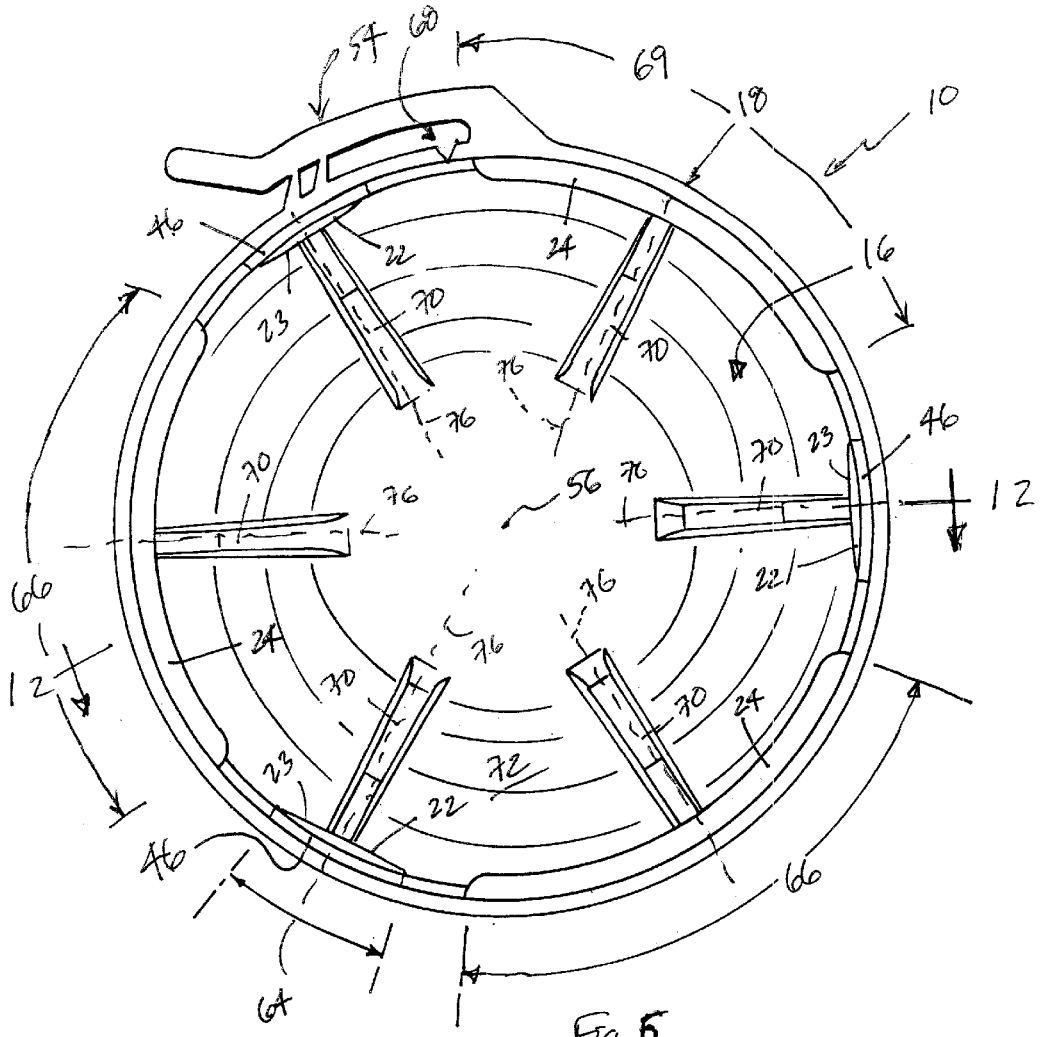
FIG. 6 is an enlarged bottom view of the closure taken along line 6—6 of FIG. 2 before the closure is first mounted on the annular ridge of the can (shown, for example, in FIG. 1) at a manufacturing plant showing three long curved tamper band retainers appended to an inner surface of the tamper band, three short somewhat "straight" cap retainers appended to an inner surface of the cap and arranged to lie in spaces between adjacent pairs of tamper band retainers, and six stacking ribs arranged in spaced-apart relation to one another to cause each of the stacking ribs to associate with a "companion" retainer and extend along a line bisecting that companion retainer.
Figure 7:
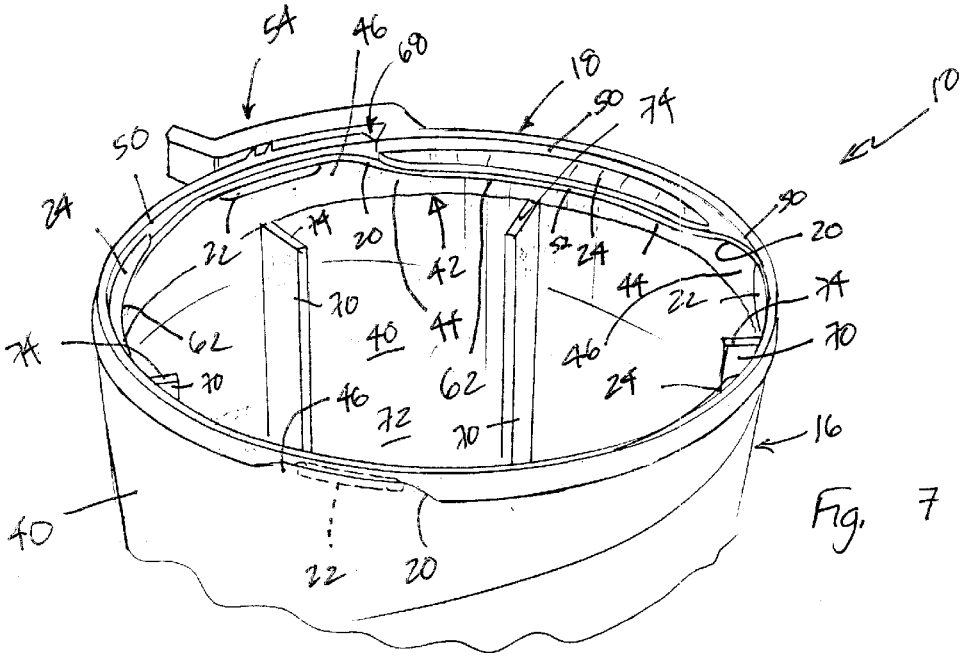
FIG. 7 is a perspective view of a portion of the cap of FIG. 6 showing the undulated frangible tear line between the cap and the removable tamper band, the three cap retainers, the three tamper band retainers, and portions of four of the six stacking ribs.
Figure 8:
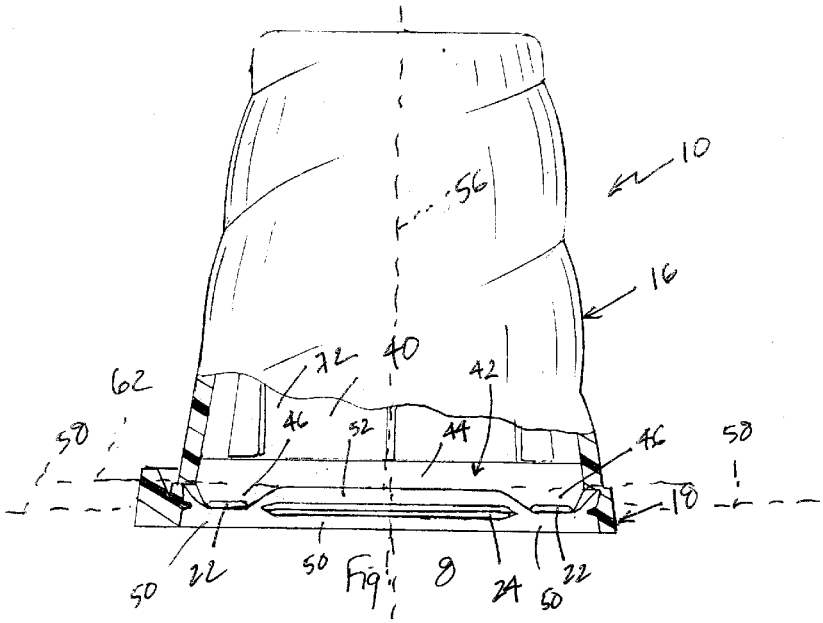
FIG. 8 is a side elevation view of the closure of FIG. 2 prior to installation of that closure on a can, with portions broken away, showing the tamper band appended to a lower edge of the cap.

A tamper-resistant closure 10 shown, for example, in FIGS. 6–8 is configured to be mounted on top of a can 12 shown, for example, in FIG. 1 to cover a product discharge valve 14 included in can 12 as shown, for example, in FIG. 2. Closure 10 comprises a cap 16 and a removable tamper band 18 coupled to a lower edge of cap 16 to define an undulated frangible tear line 20 between cap 16 and tamper band 18 as shown, for example, in FIGS. 4 and 7–10.

Closure 10 includes cap retainers 22 provided on the lower edge of an inner surface of cap 16 and band retainers 24 provided on an inner surface of tamper band 18 as shown, for example, in FIGS. 6–10. These cap retainers 22 and band retainers 24 engage an annular ridge 26 (see FIG. 1) included on top of can 12 and cooperate to retain cap 16 in place on can 12 after closure 10 is mounted on can 12 at a can manufacturing plant as shown, for example, in FIGS. 12 and 13. Cap retainers 22 and band retainers 24 cooperate to retain cap 16 in place on can 12 until a consumer later removes tamper band 18 from cap 16 just before the consumer removes cap 16 to operate product discharge valve 14 in the usual way to discharge a pressurized product such as whipped cream from can 12 for the first time.

Tamper band 18 can be separated from cap 16 easily along undulated frangible tear line 20 using finger-pull tab 54 in a manner shown, for example, in FIGS. 2–4. Once tamper band 18 has been separated from can 12, cap 16 is retained on can 12 only by engagement of cap retainers 22 provided on the lower edge of cap 16 with annular ridge 26 on top of can 12. Cap 16 can now be removed from and remounted on can 12 easily at the option of the consumer. In each case, once remounted on can 12, cap 16 will be retained in its mounted position on can 12 by engagement of cap retainers 22 with annular ridge 26 on top of can 12 as shown, for example, in FIGS. 5 and 14.

As shown in FIG. 1, can 12 comprises a body 30, a dome 32 coupled to a top end of body 30 at annular chime 34, product discharge valve 14 mounted on ceiling 36, and annular ridge 26 extending upwardly from ceiling 36 and surrounding product discharge valve 14. Although valve 14 is a tilt-actuated valve, it is within the scope of this disclosure to include any suitable valve 14 in can 12. Moreover, ridge 26 could be somewhat irregular or discontinuous without departing from the disclosure made herein. Although closure 10 is shown to be mounted on a pressurized can, it is within the scope of this disclosure to configure closure 10 to mount on a wide variety of pressurized and non-pressurized containers.

Figure 9:
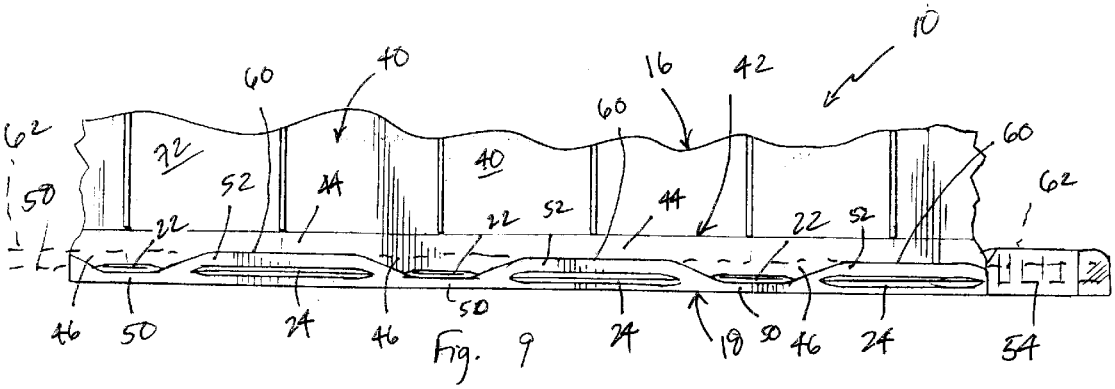
FIG. 9 is a "flat development" of a lower portion of the closure before removal of the tamper band from the cap showing the three short cap retainers "above" the undulated frangible tear line, the three long tamper band retainers "below" the undulated frangible tear line, the finger-pull tab included in the tamper band, and lowermost ends of the six stacking ribs.

Referring now to FIGS. 7–9, cap 16 includes a side wall 40 having an annular lower rim 42. Annular lower rim 42 comprises an annular rim strip 44 and a series of downwardly extending retainer tabs 46. As shown best in FIGS. 6 and 7, retainer tabs 46 are positioned to lie in circumferentially spaced-apart relation to one another about annular rim strip 44. As shown best in FIGS. 8–10, each cap retainer 22 is coupled to an inner surface of a lowermost edge of one of the downwardly extending retainer tabs 46.

Continuing to refer to FIGS. 7–9, removable tamper band 18 comprises a band strip 50 and a series of upwardly extending retainer mounts 52 coupled to band strip 50. As shown best in FIGS. 6 and 7, retainer mounts 52 are positioned to lie in circumferentially spaced-apart relation to one another about band strip 50. As shown best in FIGS. 8–10, each band retainer 24 is coupled to an inner surface of one of the retainer mounts 52 and arranged to extend along a portion of the boundary between a retainer mount 52 and the band strip 50. Removable tamper band 18 further includes a finger-pull tab 54 coupled to one end of band strip 50 and configured to be gripped by a user to facilitate separation of tamper band 18 from cap 16 by the user.

Figure 10:
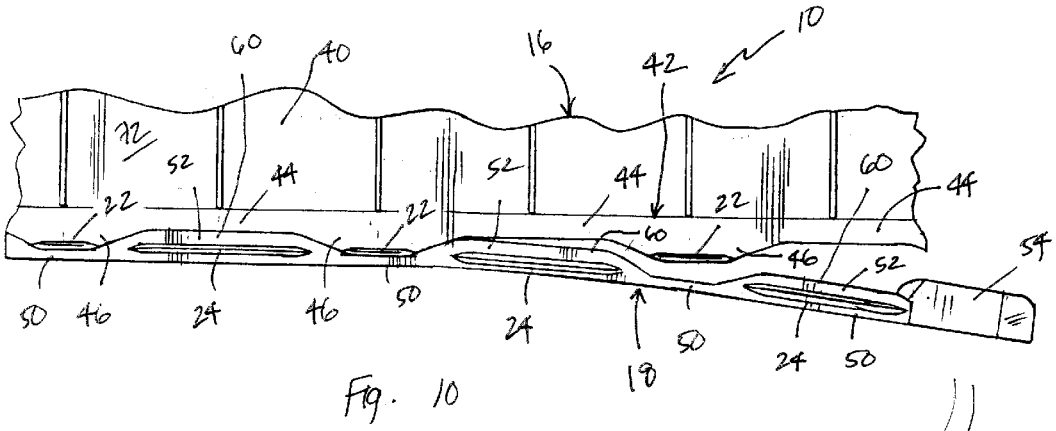
FIG. 10 is a view similar to FIG. 9 showing partial separation of the removable tamper band from the lower edge of the cap along the undulated frangible tear line.
Figure 11:
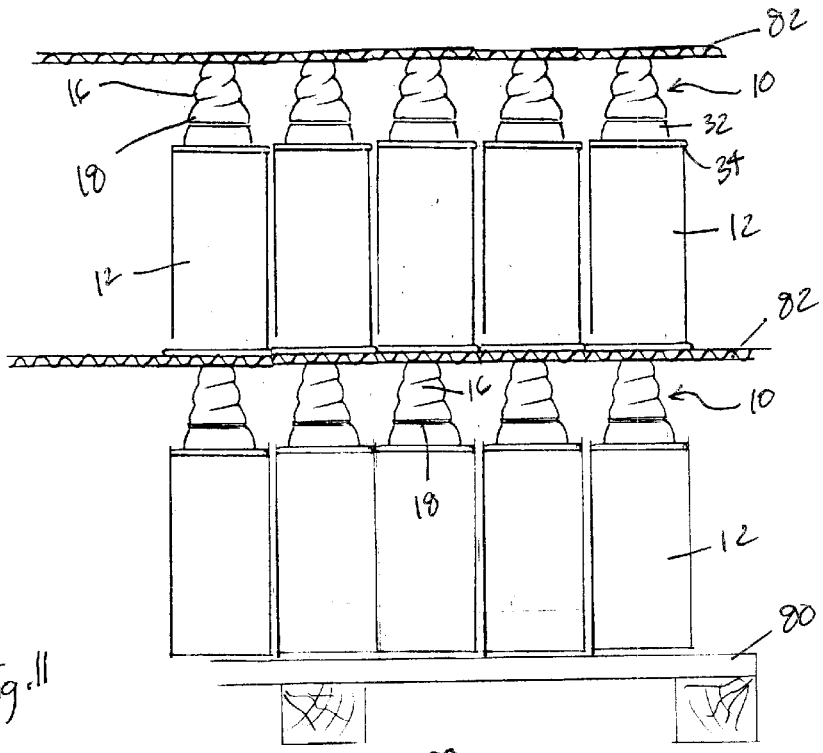
FIG. 11 is a side elevation view of one set of cans stacked on and above a lower set of cans with a sheet of corrugated material above the lower set of cans and supporting the upper set of cans.

As shown best in FIGS. 9 and 10, removable tamper band 18 is coupled to annular lower rim 42 of cap 16 to define frangible tear line 20 therebetween. In the illustrated embodiment, frangible tear line 20 is undulated.

As shown, for example, in FIG. 8, cap 16 has a central axis 56 and each of cap retainers 22 and band retainers 24 intersect a reference plane 58 perpendicular to central axis 56 while tamper band 18 remains coupled to cap 16 along undulated frangible tear line 20. Each of the upwardly extending retainer mounts 52 lies in a space between a pair of adjacent retainer tabs 46 as shown, for example, in FIG. 9 to establish an annular alternating series of downwardly extending retainer tabs and upwardly extending retainer mounts lying in end-to-end relation to one another between annular rim strip 44 and annular band strip 50 and between reference planes 58 and 62.

Each upwardly extending retainer mount 52 includes an uppermost edge 60 extending along portions of undulated frangible tear line 20 as shown, for example, in FIG. 9. These uppermost edges 60 lie in a second reference plane 62 perpendicular to central axis 56 and above plane 54 as shown, for example, in FIGS. 8 and 9. As suggested in FIG. 7, these uppermost edges 60 are curved about central axis 56 of cap 16.

Referring now to FIG. 6, it will be seen that cap retainers 22 are relatively short as compared to the longer band retainers 24. Each cap retainer 22 subtends an angle 64 of about 23° and in a preferred embodiment 23.5°. The total or cumulative arc length of all three cap retainers 22 is 70.5°. Two of the band retainers 24 subtend an angle 66 of about 75° and a third of the band retainers 24 (i.e., the band retainer located near tear band slot 68) subtends an angle 69 of about 69°. The total or cumulative arc length of all three band retainers 24 is 219.3°. The total or cumulative arc length of all six retainers 22, 24 is 289.8°. Angles 64, 66, 69 are measured from "blend-in" to "blend-in."

Figure 14:
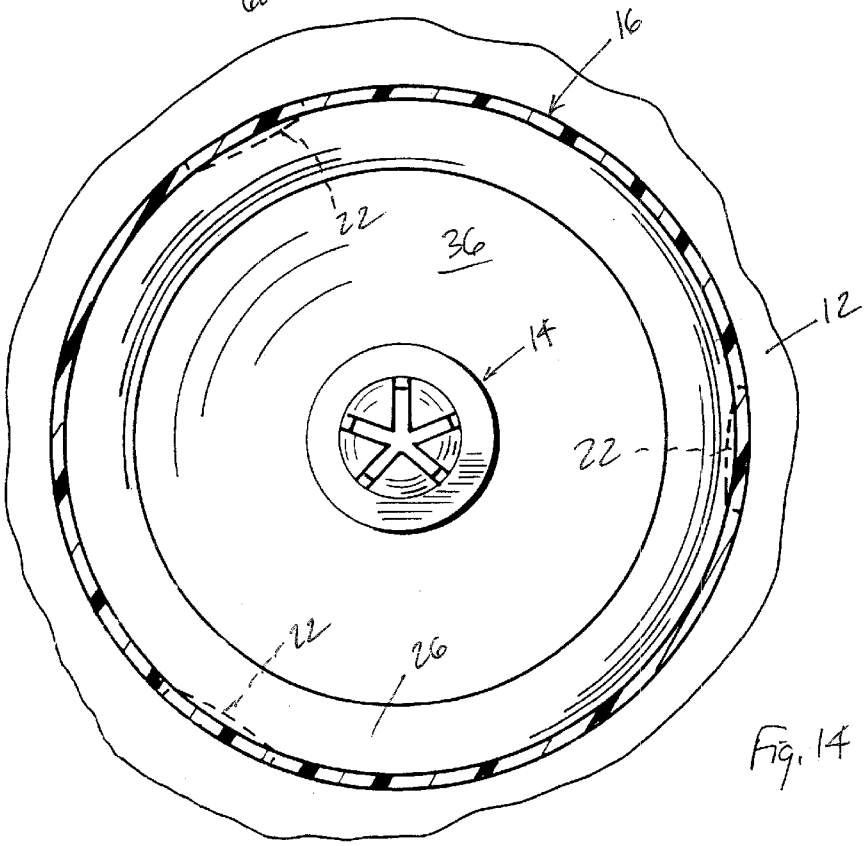
FIG. 14 is a sectional view of the closure (after removal of the tamper band from the cap) taken along line 14—14 of FIG. 5 showing that after removal of the tamper band from the cap only the three short cap retainers (shown in phantom) cooperate to retain the cap in a mounted position on the can as shown in FIG. 5.

Cap retainers 22 and band retainers 24 cooperate to engage effectively about 80% of annular ridge 26 (e.g., 289.8/360) on can 12 when tamper band 18 is attached to side wall 40 of cap 16 and closure 10 is mounted on can 12 in a "tamper-resistant" position as shown, for example, in FIGS. 2 and 14. Cap retainers 22 alone cooperate to engage effectively about 20% of annular ridge 26 (e.g., 70.5/360) on can 12 upon removal of tamper band 18 from side wall 40 of cap 16 and closure 10 is mounted on can 12 in a "normal-closure" position as shown, for example, in FIGS. 5 and 14. As shown best in FIG. 6 in the illustrated embodiment, each cap retainer 22 is "cut" flat across to present a straight edge 23 so that cap retainers 22 are not cut radially and do not follow the curvature of the cap.

Cap 16 further comprises a series of upright stacking ribs 70 appended to a somewhat frustoconical inner surface 72 of side wall 40. The ribs 70 are arranged to lie in uniformly circumferentially spaced-apart relation to one another about inner surface 72 of side wall 40. As shown best in FIG. 6, in an illustrated embodiment, each upright stacking rib 70 is associated with only one of retainer tabs 22 and retainer mounts 24. Each upright stacking rib 70 includes a lowermost end 74 positioned to lie adjacent to said only one of the retainer tabs 22 and retainer mounts 24 as shown, for example, in FIGS. 7–9 and along a line 76 bisecting said only one of the retainer tabs 22 and retainer mounts 24 as shown, for example, in FIG. 6.

Figure 12:
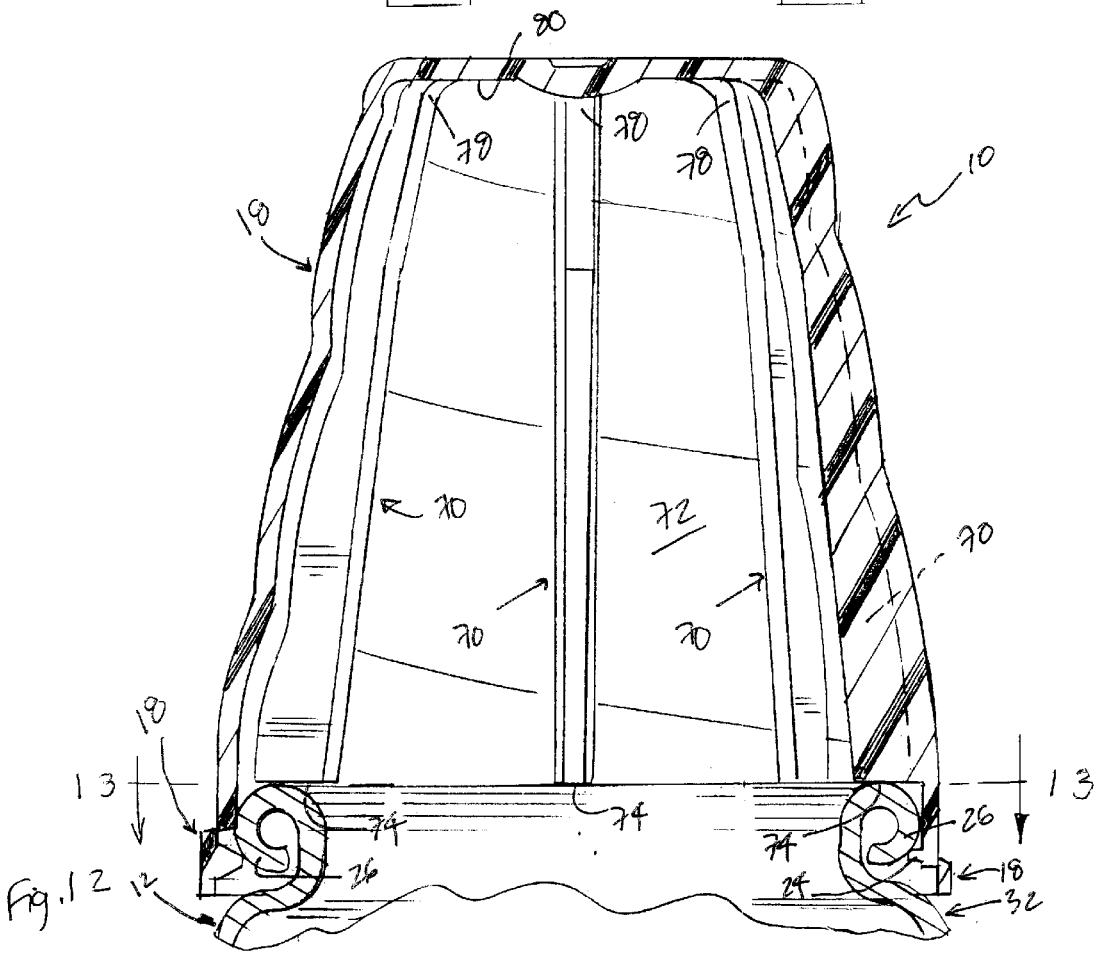
FIG. 12 is a sectional view of the closure of FIG. 2 taken along line 12—12 of FIG. 6 mounted on an annular ridge of a can showing the height and configuration of several of the stacking ribs and omitting the discharge valve that is mounted on the top dome of the can and surrounded by the annular ridge.
Figure 13:
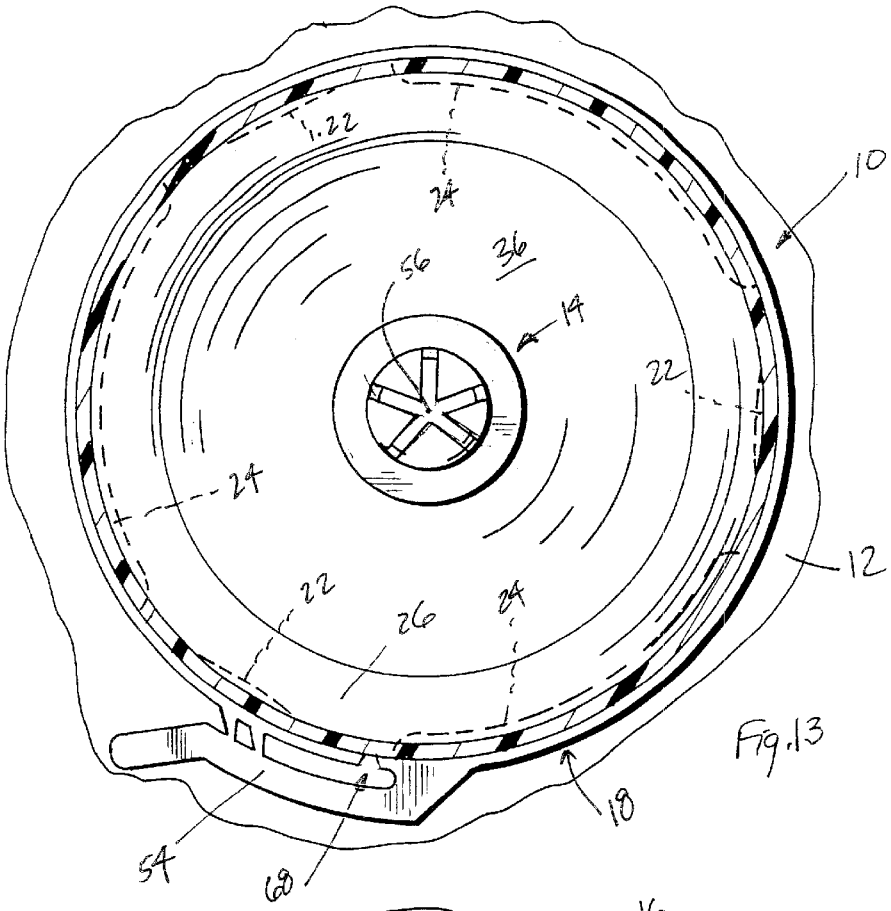
FIG. 13 is a sectional view of the closure (before removal of the tamper band) taken along line 13—13 of FIG. 12 showing that when the tamper band is coupled to the cap and used to retain the closure on the can that the three long curved tamper band retainers (shown in phantom) and the three short cap retainers (also shown in phantom) cooperate to engage the annular ridge of the can to retain the closure in a mounted position on the can as shown in FIG. 2.

The lowermost end 74 of each upright stacking rib 70 is spaced apart from frangible tear line 20 and adapted to engage an upper portion of annular ridge 26 on can 12 as shown, for example, in FIG. 12. At the warehouse, a first set of cans 12 is set on a pallet 80 and a second set of cans 12 is set on a cardboard sheet 82 that is set on top of closures 10 included in the underlying first set of cans 12. Upright stacking ribs 70 cooperate to prevent deformation of closures 10 under loads applied by overlying sets of stacked cans, which deformation could lead to unwanted premature product discharge from cans 12. Each upright stacking rib 70 extends from lowermost end 74 to an uppermost end 78 terminating at a ceiling 80 of cap 16 as shown, for example, in FIG. 12.

Although the invention has been described in detail with reference to certain preferred embodiments, variations and modifications exist within the scope and spirit of the invention as described and defined in the following claims.

What is claimed is:

1. A tamper-resistant closure for mounting on a can having a body and a dome coupled to a top end of the body and formed to include an annular ridge surrounding a discharge valve mounted on the dome, the closure comprising a cap including a side wall having an annular lower rim, a removable tamper band coupled to a lower edge of the annular lower rim to define a frangible tear line therebetween, means for engaging an annular ridge on a can to retain the can on the can when the closure is mounted on the can in a tamper-resistant position the engaging means including cap retainers coupled to the annular lower rim and tamper band retainers coupled to the removable tamper band, wherein the annular lower rim includes an annular rim strip and a series of downwardly extending retainer tabs positioned to lie in circumferentially spaced-apart relation to one another about the annular rim strip, the removeble tamper band includes an annular band strip and a series upwardly extending retainer mounts arranged to lie in circumferentially spaced-apart relation to one another about the annular band strip and in spaces defined between adjacent downwardly extending retainer tabs to establish an annular alternating series of downwardly extending retainer tabs and upwardly extending retainer mounts lying in end-to-end relation to one another between the annular rim strip and band strip; and wherein a first of the tamper band retainers subtends an angle of about 69°, a first of the cap retainers subtends an angle of about 23.5°, a second of the tamper band retainers subtends an angle of about 75°, a second of the cap retainers subtends an angle of about 23.5°, a third of the tamper band retainers subtends an angle of about 75°, and a third of the cap retainers subtends an angle of about 23.5°.

2. The closure of claim 1, wherein the frangible tear line is undulated to lie between each tamper band retainer and the side wall and also between each cap retainer and a lowermost edge of the removable tamper band while the tamper band is coupled to the annular lower rim of the cap.

3. The closure of claim 1, wherein the annular lower rim includes a rim strip and a series of downwardly extending retainer tabs coupled to the rim strip and arranged to lie along portions of the undulated frangible tear line and each of the cap retainers is appended to one of the downwardly extending retainer tabs.

4. The closure of claim 1, wherein the removable tamper band includes a band strip and a series of upwardly extending retainer mounts coupled to the band strip and arranged to lie along portions of the undulated frangible tear line and each of the tamper band retainers is appended to one of the upwardly extending retainer mounts.

5. The closure of claim 1, wherein the frangible tear line is undulated, each upwardly extending retainer mount includes a curved uppermost edge extending along portions of the frangible tear line, and each downwardly extending retainer tab includes a curved lowermost edge extending along other portions of the frangible tear line.

6. The closure of claim 1, wherein the cap has a central axis and each of the cap retainers and tamper band retainers intersect a first plane perpendicular to the central axis.

7. The closure of claim 6, wherein the frangible tear line is undulated and each upwardly extending retainer mount includes an uppermost edge extending along portions of the frangible tear line and lying in a second plane perpendicular to the central axis and above the first plane.

8. The closure of claim 1, wherein the annular lower rim includes a rim strip having a lower edge and retainer tabs coupled to the lower edge of the rim strip and arranged to extend downwardly away from the lower edge of the rim strip and each of the cap retainers is coupled to one of the retainer tabs.

9. The closure of claim 8, wherein the engaging means includes three retainer tabs and the cap retainer on each retainer tab subtends an angle of about 23.5°.

10. The closure of claim 8, wherein the rim strip is annular, the retainer tabs are uniformly spaced apart about the circumference of the annular rim strip to define spaces therebetween, the tamper band includes a band strip having an upper edge and retainer mounts coupled to the upper edge of the band strip and arranged to extend upwardly away from the upper edge of the band strip, each of the retainer mounts is positioned to lie in one of the spaces formed between a pair of adjacent retainer tabs to cause each of such spaces to be occupied by one of the tamper band retainer mounts, and each of the tamper band retainers is coupled to one of the retainer mounts.

11. The closure of claim 10, wherein the cap further includes a series of upright stacking ribs appended to a frustoconical-conical inner surface of the side wall and arranged to lie in uniformly circumferentially spaced-apart relation about the frustoconical-conical inner surface and each upright stacking rib is associated with only one of the retainer tabs and retainer mounts and includes a lowermost end positioned to lie adjacent to said only one of the retainer tabs and retainer mounts and along a line bisecting said only one of the retainer tabs and retainer mounts.

12. The closure of claim 10, wherein the engaging means includes three retainer mounts and the tamper band retainer on each retainer mount subtends an angle of at least 60°.

13. The closure of claim 10, wherein the engaging means includes three retainer mounts, two of the tamper band retainers subtend angles of about 75°, and another of the tamper band retainers subtend an angle of about 69°.

14. The closure of claim 1, wherein the frangible tear line is undulated to define a series of spaced-apart, downwardly projecting retainer tabs in the annular lower rim above the undulated frangible tear line and a series of spaced-apart upwardly projecting retainer mounts in the removable tamper band below the undulated frangible tear line, one of the cap retainers is coupled to each of the downwardly projecting retainer tabs, and one of the tamper band retainers is coupled to each of the upwardly projecting retainer mounts.

15. The closure of claim 14, wherein the cap further includes a series of upright stacking ribs appended to a frustoconical-conical inner surface of the side wall and arranged to lie in uniformly circumferentially spaced-apart relation about the frustoconical-conical inner surface and each upright stacking rib is associated with only one of the retainer tabs and retainer mounts and includes a lowermost end positioned to be adjacent to said only one of the retainer tabs and retainer mounts.

16. The closure of claim 14, wherein each pair of adjacent downwardly projecting retainer tabs is positioned to lie in circumferentially spaced-apart relation one to another to define a space therebetween containing one of the upwardly projecting retainer mounts therein.

17. The closure of claim 16, wherein the cap has a central axis and each of the cap retainers and tamper band retainers intersect a first plane perpendicular to the central axis.

18. The closure of claim 16, wherein the cap further includes a series of upright stacking ribs appended to a frustoconical-conical inner surface of the side wall and arranged to lie in uniformly circumferentially spaced-apart relation about the frustoconical-conical inner surface end each upright stacking rib is associated with only one of the retainer tabs and retainer mounts and includes a lowermost end positioned to be adjacent to said only one of the retainer tabs and retainer mounts.

19. A tamper-resistant closure for mounting on a can having a body and a dome coupled to a top end of the body and formed to include an annular ridge surrounding a discharge valve mounted on the dome, the closure comprising a can including a side wall having an annular lower rim, a removable tamper band coupled to a lower edge of the annular lower rim to define a frangible tear line therebetween, means for engaging an annular ridge on a can to retain the cap on the can when the closure is mounted on the can in a tamper-resistant position, the engaging means including cap retainers coupled to the annular lower rim and tamper band retainers coupled to the removable tamper band, wherein the annular lower rim includes an annular rim strip and a series of downwardly extending retainer tabs positioned to lie in circumferentially spaced-apart relation to one another about the annular rim strip, the removable tamper band includes an annular band strip and a series of upwardly extending retainer mounts arranged to lie in circumferentially spaced-apart relation to one another about the annular band strip and spaces defined between adjacent downwardly extending retainer tabs to establish an annular alternating series of downwardly extending retainer tabs and upwardly extending retainer mounts lying in end-to-end relation to one another between the annular rim strip and band strip; and wherein the cap further includes a series of upright stacking ribs appended to a frustoconical-conical inner surface of the side wall and arranged to lie in uniformly circumferentially spaced-apart relation about the frustoconical-conical inner surface and each upright stacking rib is associated with only one of the retainer tabs and retainer mounts and includes a lowermost end positioned to lie adjacent to said only one of the retainer tabs and retainer mounts and along a line bisecting said only one of the retainer tabs and retainer mounts.

20. A tamper-resistant closure for mounting on a can having a body and a dome coupled to a top end of the body and formed to include an annular ridge surrounding a discharge valve mounted on the dome, the closure comprising a cap including a side wall, a removable tamper band coupled to the side wall to define a frangible line therebetween, and means for effectively engaging about 80% of an annular ridge on a can when the tamper band is attached to the side wall and the closure is mounted on the can in a tamper-resistant position and about 20% of an annular ridge on a can upon removal of the tamper band from the side wall and the closure is mounted on the can in a normal-closure position.

21. The closure of claim 20, wherein the engaging means includes three tamper band retainers coupled to the tamper band and three cap retainers coupled to the side wall, each of the tamper band retainers subtends an angle of more than 60° to cause the three tamper band retainers to be adapted to engage about 60% of an annular ridge on a can when the tamper band is attached to the side wall and the closure is mounted on the can in a tamper-resistant position, and each of the cap retainers subtends an angle of about 23° to cause the three caps retainers to be adapted to engage about 20% of an annular ridge on a can when the closure is mounted on the can and even after removal of the tamper band from the cap.

22. The closure of claim 21, where the cap has a central axis and each of the cap retainers and tamper band retainers intersect a first plane perpendicular to the central axis.

23. The closure of claim 21, wherein the engaging means includes three tamper band retainers coupled to the tamper band and three cap retainers coupled to the side wall, each of the tamper band retainers subtends an angle of more than 60° to cause the three tamper band retainers to be adapted to engage about 60% of an annular ridge on a can when the tamper baud is attached to the side wall and the closure is mounted on the can in a tamper-resistant position, and each of the cap retainers subtends an angle of about 23° to cause the three caps retainers to be adapted to engage about 20% of an annular ridge on a can when the closure is mounted on the can and even after removal of the tamper band from the cap.

24. The closure of claim 21, wherein the cap further includes a series of upright stacking ribs appended to a frustoconical-conical inner surface of the side wall and arranged to lie in uniformly circumferentially spaced-apart relation about the frustoconical-conical inner surface and each upright stacking rib is associated with only one of the cap retainers and tamper band retainers and includes a lowermost end positioned to lie adjacent to said only one of the cap retainers and tamper band retainers and along a line bisecting said only one of the cap retainers and tamper band retainers.

25. The closure of claims 20, wherein the frangible tear line is undulated and the engaging means includes a plurality of cap retainers coupled to the side wall and positioned to lie above the undulated frangible tear line and a plurality of tamper band retainers coupled to the tamper band and positioned to lie below the undulated frangible tear line so as to be separated from the side wall upon removal of the tamper band from the side wall.

26. The closure of claim 25, wherein the engaging means includes three circumferentially spaced-apart cap retainers on an inner surface of the side wall.

27. The closure of claim 26, wherein the engaging means further includes three circumferentially spaced-apart tamper band retainers on an inner surface of the tamper band.

28. The closure of claim 27, wherein each of the tamper band retainers is positioned to lie in a space defined between each adjacent pair of circumferentially spaced-apart cap retainers.

29. A tamper-resistant closure for mounting on a can having a body and a dome coupled to a top end of the and formed to include an annular ridge surrounding a discharge valve mounted on the dome, the closure comprising, a cap including a side wall having an inner surface, a removable tamper band coupled to a lower edge of the side wall to define a frangible tear line therebetween, a plurality of cap retainers coupled to the inner surface of the side wall to along and above the frangible tear line and adapted to engage an annular ridge on a can when the cap is mounted on the can, and a plurality of tamper band retainers coupled to an inner surface of removable tamper band to lie along and below the frangible tear line and adapted to engage an annular ridge on a can where the removeable tamper band is coupled to the lower edge of the side wall and the cap is mounted on the can, wherein the cap further includes a series of upright stacking ribs appended to the inner surface of the side wall and arranged to lie in uniformly circumferentially spaced-apart relation about the inner surface and each upright stacking rib is associated with only one of the cap retainers and tamper band retainers and includes a lowermost end positioned to lie adjacent to said only one of the cap retainers and tamper band retainers and along a line bisecting said only one of the cap retainers and tamper band retainers.

30. The closure of claim 29, wherein the frangible tear line is undulated.

31. The closure of claim 30, wherein the cap has a central axis and each of the cap retainers and tamper band retainers intersect a first plane perpendicular to the central axis.

32. A tamper-resistant closure for mounting on a can having a body and a dome coupled to a top end of the body and formed to include an annular ridge surrounding a discharge valve mounted on the dome, the closure comprising a cap including a side wall having an inner surface, a removable tamper band coupled to a lower edge of the side wall to define a frangible tear line therebetween, a plurality of cap retainer coupled to the inner surface of the side wall to lie along and above the frangible tear line and adapted to engage an annular ridge on a can when the cap is mounted on the can, and a plurality of tamper band retainers coupled to an inner surface of the removable tamper band to lie along and below the frangible tear line and adapted to engage an annular ridge on a can where the removable tamper band is coupled to the lower edge of the side wall and the cap is mounted on the can, wherein a first of the tamper band retainers subtends an angle of about 69°, a first of the cap retainers subtends an angle of about 23.5°, a second of the tamper band retainers subtends an angle of about 75°, a second of the cap retainers subtends an angle of about 23.5°, a third of the tamper band retainers subtends an angle of about 75°, and a third of the cap retainers subtends an angle of about 23.5°.

* * * * *